United States Patent [19]

Cuozzo

[11] 4,075,796

[45] Feb. 28, 1978

[54] ADJUSTABLE HEIGHT MANHOLE WITH LOCKING MEANS

[76] Inventor: Benjamin D. Cuozzo, 15 Mackey Road, Garnerville, N.Y. 10923

[21] Appl. No.: 781,436

[22] Filed: Mar. 25, 1977

[51] Int. Cl.[2] ..... E02D 29/14

[52] U.S. Cl. ..... 52/20; 404/26

[58] Field of Search ..... 52/19–21, 52/221; 404/25, 26; 210/163, 164; 292/145, 256.5

[56] References Cited

U.S. PATENT DOCUMENTS

| | | | |
|---|---|---|---|
| 829,862 | 8/1906 | Ely | 292/256.5 |
| 1,541,436 | 6/1925 | Reshan | 210/163 |
| 3,230,844 | 1/1966 | Isaacs | 52/20 |
| 3,533,199 | 10/1970 | Pickett | 52/20 |
| 3,629,981 | 12/1971 | McCaffery | 52/19 |

FOREIGN PATENT DOCUMENTS

| | | | |
|---|---|---|---|
| 6,413,948 | 6/1966 | Netherlands | 52/20 |
| 527,582 | 10/1940 | United Kingdom | 52/20 |

*Primary Examiner*—Alfred C. Perham
*Assistant Examiner*—Henry Raduazo

[57] ABSTRACT

This manhole consists primarily of a cast and internally threaded main body, which receives a cast and internally threaded sleeve, which may be raised to different pavement levels by means of a removable spanner wrench. It includes a pair of diametrically opposed and slidable locking plates, which have pin means on the underside for being received within openings on the upper interior of the sleeve, and the upper portion of the plates projects outwards of the sleeve, so as to lock the sleeve and cover within the main body, thus preventing rotation thereof, the plates when the sleeve is lowered or elevated, serving as a means of rendering the sleeve and cover stationary at various pavement levels.

5 Claims, 7 Drawing Figures

FIG.1
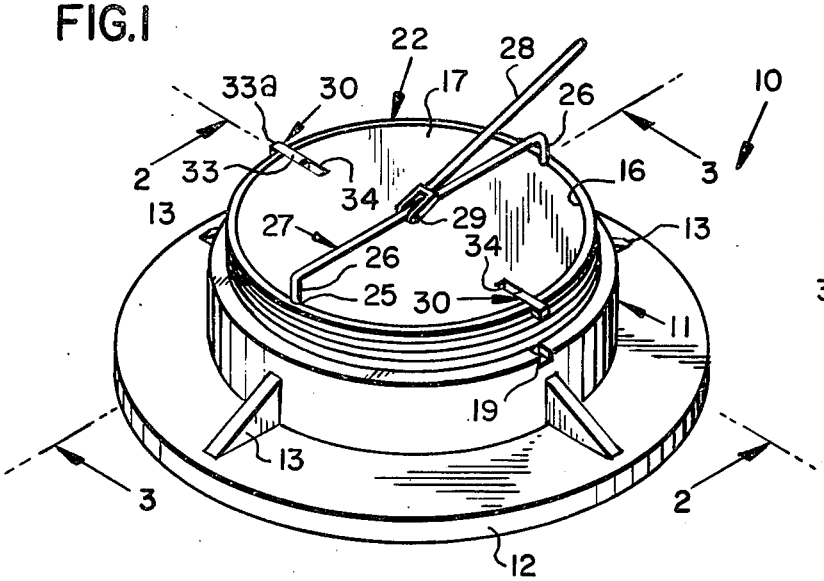
FIG.4
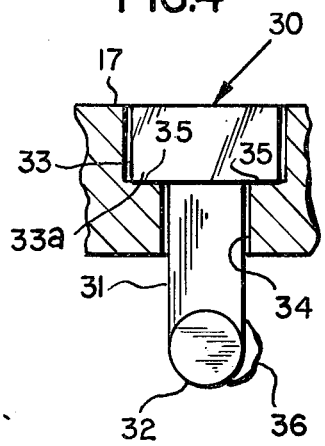
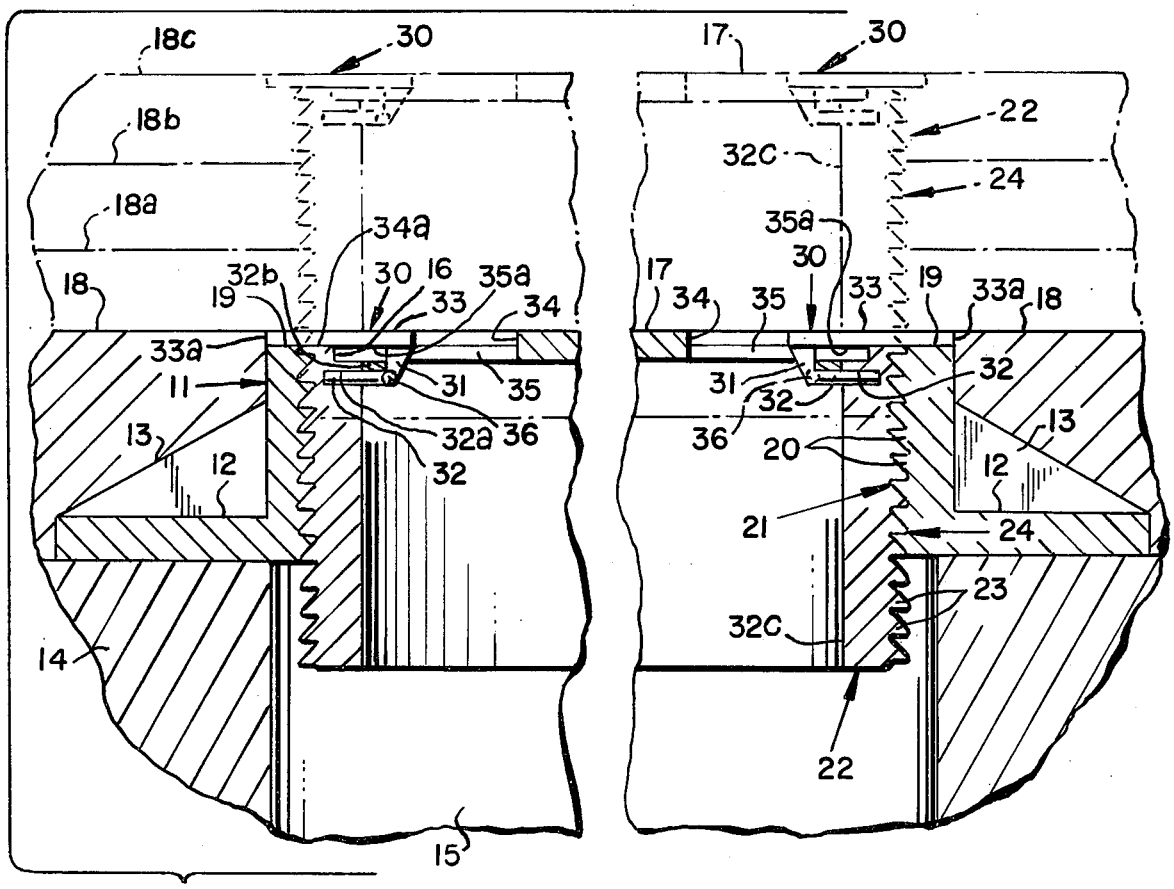
FIG.2
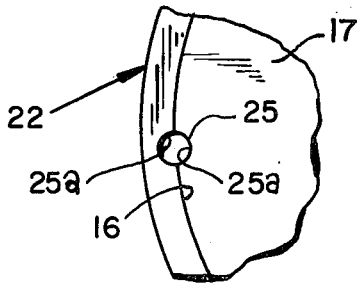
FIG.7

ADJUSTABLE HEIGHT MANHOLE WITH LOCKING MEANS

This invention relates to manholes, and more particularly, to an adjustable height manhole with locking means.

It is, therefore, the principal object of this invention to provide an adjustable height manhole with locking means, which will prevent having to remove and reseat an entire manhole structure, as was the prior art, whenever pavement levels are altered. Examples of the prior art, for the aforementioned purpose, are shown in U.S. Pat. Nos. 3,392,640; 3,533,199 and 3,629,981.

Devices of the prior art, while functional, have not been practical. Thus, they have not been widely adopted. In all known adjustable height manholes, it has been necessary to remove the manhole cover and gain access to the interior thereof, so as to make an adjustment. This decreases the element of safety for the workman, enables foreign matter to enter the manhole during the adjustment operation, requires extra labor for cleaning out the manhole, and increases the possibility of clogging drainage systems.

Another object of the present invention is to provide an adjustable height manhole with locking means, which will be of such structure, that the cover will be rendered stationary, when the elevatable sleeve is secured within the main body.

A further object of this invention is to provide an adjustable height manhole with locking means, of the type described, which will be of cast material, thus preventing the possibility of rust or corrosion forming on the thread portions, which would occur if the threads were machined.

A still further object of this invention is to provide an adjustable height manhole, with locking means, which will eleminate the necessity for sealing gaskets, which have been used in the prior art types.

Other objects of the invention are to provide an adjustable height manhole with locking means, which is simple in design, inexpensive to manufacture, rugged in construction, and efficient in use.

These, and other objects, will be readily evident, upon a study of the following specification, and the accompanying drawings, wherein:

FIG. 1 is a perspective view of the present invention;

FIG. 2 is an enlarged cross-sectional view, taken along the line 2—2 of FIG. 1, and illustrates different pavement levels in phantom lines;

FIG. 4 is an enlarged end view of one of the locking plates, shown in place within the manhole cover, which is shown fragmentary and in section;

FIG. 7 is a fragmentary top plan view of the sleeve and cover showing one of the diametrically opposed openings for receiving the spanner wrench.

Figure 3:
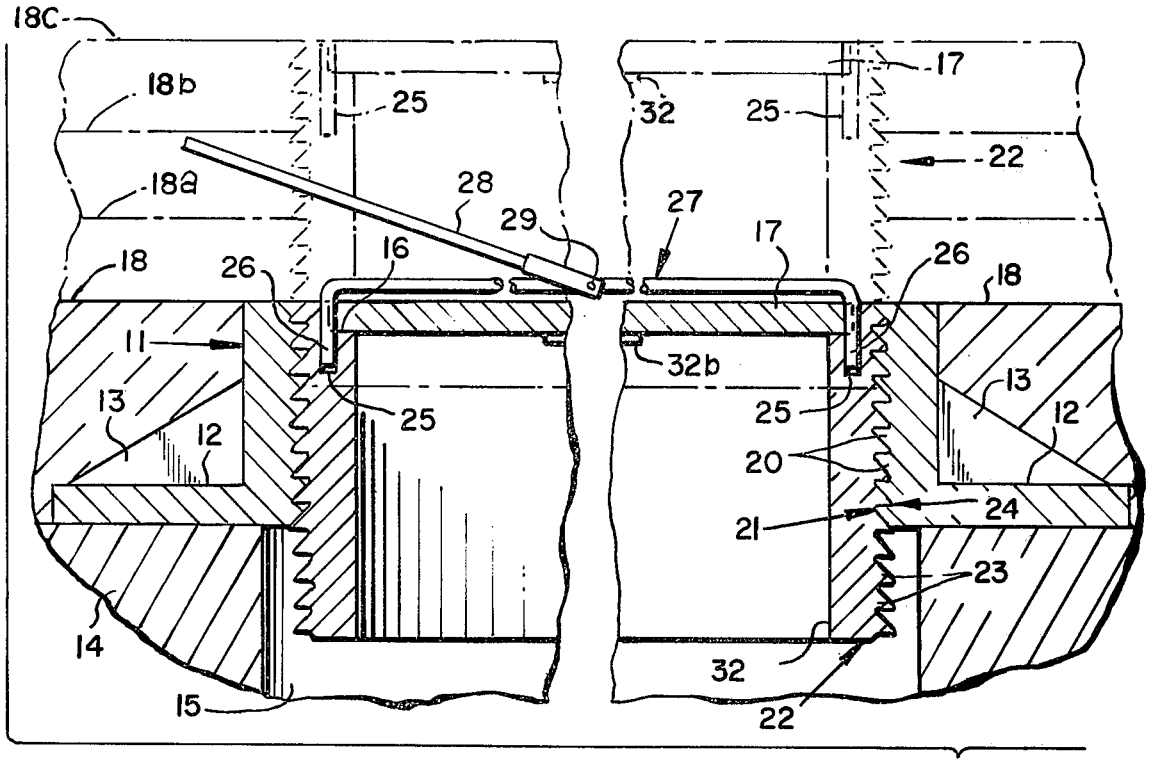
FIG. 3 is a cross-sectional view taken along the line 3—3 of FIG. 1.
Figure 5:
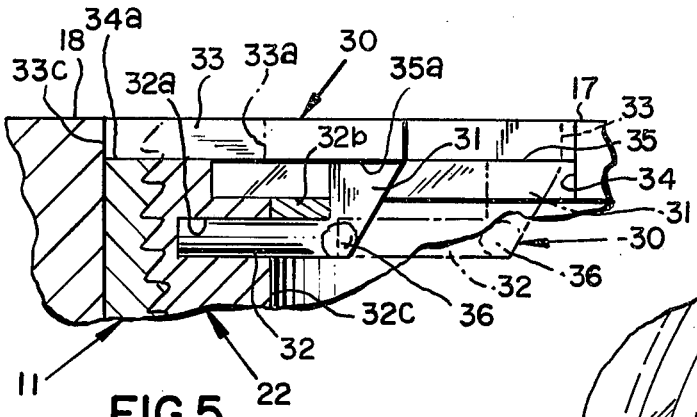
FIG. 5 is an enlarged cross-sectional view, taken along the line 505 of FIG. 6, and illustrates the before-locking position of the locking plate, in phantom lines.
Figure 6:
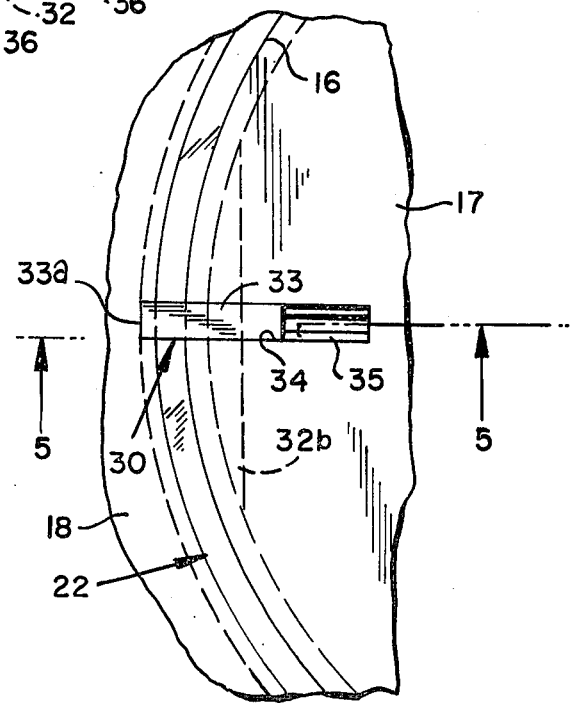
FIG. 6 is a fragmentary top plan view of the invention, shown installed in pavement.

According to this invention, an adjustable height manhole 10, with locking means, is shown to include a hollow cylindrical main body 11 of cast metal. It is provided with an annular base flange 12, which is reinforced by means of a plurality of radially and equally spaced apart web portions 13, which are integral with main body 11. Flange 12 provides support means against ground 14, the opening 15 therein, being in vertical alignment with the longitudinal axis of main body 11. The upper end of main body 11 is provided with a recessed opening 16, in which is removably received a metal cover 17. When installed, the cover 17, and the upper end of main body 11, are flush with pavement level 18. A pair of diametrically opposed slots 19, in the upper surface of main body 11, are provided therein, for a purpose which hereinafter will be described.

Threads 20 on the inner periphery 21 of main body 11, provide a means of receiving a hollow cylindrical sleeve 22, which is of cast metal. Threads 23, on the outer periphery 24, of sleeve 22, rotatably engage threads 20 of main body 11, so as to enable sleeve 22 to be elevated or lowered to any of the pavement levels 18, **18*a*, 18*b*, or 18*c*. A pair of diametrically opposed and vertical openings 25, are formed by semi-circular grooves 25*a* in the cover 17 and sleeve 22, so as to removably receive the ends 26 of spanner wrench 27, which is used to raise or lower sleeve 22 and cover 17, simultaneously. Wrench 27 is provided with a handle 28, which is pivotally secured to the center of spanner wrench 27. Handle 28 is of sufficient length, so as to provide the necessary mechanical advantage for easily rotating and elevating the sleeve 22 and cover 17 combination, to any of the pavement levels, 18, 18*a*, 18*b*, or 18*c***.

A pair of cast metal locking plates 30, are each provided with an end projection 31, which is terminated by a pin 32 of circular cross-sectional configuration. The pins 32 are removably received within the openings **32*a* of sleeve 22. The rectangular portions 33 of plates 30, are parallel spaced apart from the pins 32, and the pins 32, when received in openings 32*a*, abut on their outer peripheries with projections 32*b*. The pair of projections 32*b* are diametrically opposed to each other, and are welded, or otherwise fixedly secured, to the inner periphery 32*c* of sleeve 22, so as to render cover 17, stationary in sleeve 22, in conjunction with pins 34. The rectangular portions 33 of locking plates 30, are slidably received within the channel openings 34, which are diametrically opposed to each other in cover 17. The shoulders 35 of openings 34, provide support means for the side extending surfaces 35*a* of rectangular portions 33. The weld 36 on each of the locking plates 30 serves as stop means against the bottom of channels 34, so as to retain the locking plates 30 within the cover 17, when it is removed from sleeve 22**.

The locking plates 30, when urged radially outwards in channel openings 34 and openings **34*a*, will render cover 17 stationary against rotation, while simultaneously securing cover 17 to sleeve 22. When sleeve 22 and main body 11 are flush at the top, when at pavement level 18, the end 33*a* of portion 33, engages the opening 19, so as to render the sleeve 22 and main body 11** combination, stationary, against rotation.

When sleeve 22 is elevated, the ends **33*a* of locking plates 30, will be held secure within pavement, as shown at pavement level 18*c*, in FIG. 1 of the drawings, thus rendering the sleeve 22 and cover 17**, stationary, against rotation.

While various changes may be made in the detailed construction, it is understood that such changes will be within the spirit and scope of the present invention as is defined by the appended claims.

What I now claim is:

1. An adjustable height manhole with locking means, comprising a hollow cylindrical and internally threaded main body having an annular base flange integral of the exterior of said main body, for supporting said main body within a ground opening, a hollow cylindrical, externally threaded sleeve rotatably received within said main body, providing adjustable elevation means for the top portion of said manhole, said sleeve having a cover removably received therein, said cover and said sleeve having adjacent openings removably receiving a spanner wrench, thus providing a means for raising and lowering said sleeve to various pavement levels, and said locking means comprising a pair of locking plates which are slidable in a pair of channel openings provided in said cover, said sleeve and said main body, so as to lock said cover and said sleeve against rotation within said main body at a first pavement level, said locking plates also including pin means integral therewith, which are removably received within opening means on the inner periphery of said sleeve, so as to lock and retain said cover in the top of said sleeve.

2. The combination according to claim 1, wherein said sleeve is rotatably and telescoping received within said main body, said main body having its longitudinal axis in alignment with the longitudinal axis of said sleeve, and said base flange of said main body abuts with the top of the surface of the peripheral area adjacent of the said ground opening, thus supporting said main body and said sleeve within said ground opening, and said sleeve is rotated by means of a spanner wrench, the main body of said wrench having its ends receivable within said openings of said cover and said sleeve, and the handle of said wrench being pivotally secured by pin means at the center of the main body of said spanner wrench.

3. The combination according to claim 2, wherein said openings of said sleeve and said cover, which receive said spanner wrench, are diametrically opposed and comprise semi-cirular grooves in the outer periphery of said cover and the inner periphery of said sleeve, the said grooves, when aligned with one another, provide verticle openings receiving vertically extending engaging means on said spanner wrench, so as to rotate and elevate said sleeve and said cover simultaneously, and said openings receiving said ends of said main body of said spanner wrench are circular in cross-sectional configuration in the lower portions thereof, within said sleeve, the said openings formed by said grooves, being verticle.

4. The combination according to claim 3, wherein the upper end of said sleeve is provided with a recessed opening which seats said cover and said pair of channel openings are diametrically opposed to each other in said cover, said channels extending to the outer periphery of said cover and said channels include a pair of spaced apart shoulders therein, which support the outer underside surfaces of rectangular portions of said locking plates, the top surfaces of said rectangular portions being flush with said cover, the top surface of said sleeve and said pavement level.

5. The combination according to claim 4, wherein said locking plates, when urged outwards of the center of said cover, extend into said openings in the top surface of said sleeve, thus preventing the rotation of said cover in said sleeve, and an end portion of said rectangular portions of said locking plates extends to the outer periphery of said main body when said main body is in the lowest of said pavement levels and when said sleeve is elevated to a higher one of said pavement levels, said end portions extend into, and are flush with, said pavement level, thus rendering said sleeve stationary against rotation in said pavement, and a projection on the opposite ends of said rectangular portions of said locking plates, extending downwards in the upper portion of said sleeve, extends downwards through said channel openings, said projections having a side weld, extending outwards, which serves as stop means against the bottom of said channel openings, which prevents said locking plates from being removed from said cover.

* * * * *